US011771209B2

(12) United States Patent
Younan

(10) Patent No.: US 11,771,209 B2
(45) Date of Patent: Oct. 3, 2023

(54) RECONFIGURABLE EXERCISE BACKPACK

(71) Applicant: Samuel Younan, Los Angeles, CA (US)

(72) Inventor: Samuel Younan, Los Angeles, CA (US)

( * ) Notice: Subject to any disclaimer, the term of this patent is extended or adjusted under 35 U.S.C. 154(b) by 0 days.

(21) Appl. No.: 16/887,733

(22) Filed: May 29, 2020

(65) Prior Publication Data

US 2021/0030143 A1 Feb. 4, 2021

Related U.S. Application Data

(63) Continuation of application No. 16/526,657, filed on Jul. 30, 2019, now Pat. No. 10,702,047.

(51) Int. Cl.

| | |
|---|---|
| ***A45F 4/02*** | (2006.01) |
| ***A63B 21/055*** | (2006.01) |
| ***A63B 21/00*** | (2006.01) |
| ***A63B 21/04*** | (2006.01) |
| ***A63B 23/035*** | (2006.01) |
| ***A63B 21/068*** | (2006.01) |

(52) U.S. Cl.

CPC ..... *A45F 4/02* (2013.01); *A63B 21/0442* (2013.01); *A63B 21/0552* (2013.01); *A63B 21/068* (2013.01); *A63B 21/4035* (2015.10); *A63B 23/03525* (2013.01); *A63B 2225/50* (2013.01); *A63B 2230/06* (2013.01)

(58) Field of Classification Search

CPC ..... A45F 4/02; A45F 3/04; A63B 21/0552; A63B 21/4035; A63B 21/0442; A63B 23/03525; A63B 21/068; A63B 2225/50; A63B 2230/06; A63B 2220/833; A63B 21/4019; A63B 21/4029; A63B 21/4007; A63B 21/4043; A63B 21/0602; A63B 21/065; A63B 21/0722; A63B 21/0557; A63B 2225/685; A63B 71/0036; A63B 2225/682; A63B 2225/687; A63B 2225/10; A63B 2220/80

See application file for complete search history.

(56) References Cited

U.S. PATENT DOCUMENTS

| | | | | | |
|---|---|---|---|---|---|
| 1,402,179 | A | * | 1/1922 | Piscitelli | A63B 21/0004 482/124 |
| 1,432,013 | A | * | 10/1922 | Blake | A63B 21/4009 482/124 |
| 4,513,866 | A | * | 4/1985 | Thomas | A45C 9/00 190/110 |
| 4,961,573 | A | * | 10/1990 | Wehrell | A63B 21/0552 482/124 |
| 5,199,940 | A | * | 4/1993 | Morris | A61F 5/055 128/845 |
| 5,518,481 | A | * | 5/1996 | Darkwah | A63B 21/0004 482/126 |
| 5,916,070 | A | * | 6/1999 | Donohue | A63B 23/1209 482/74 |

(Continued)

*Primary Examiner* — Garrett K Atkinson

(74) *Attorney, Agent, or Firm* — Buche & Associates, P.C.; John K. Buche; Bryce A. Johnson

(57) ABSTRACT

Disclosed is a workout backpack that is capable of enabling a plurality of unique exercises for weight training, resistance training, and complete cardio conditioning. Suitably, the disclosed workout backpack includes built-in weight compartments, hookups for resistance bands, or rucking.

1 Claim, 8 Drawing Sheets

(56) References Cited

U.S. PATENT DOCUMENTS 5,967,145 A * 10/1999 Knapik ..... A61F 5/028 128/869
6,099,441 A * 8/2000 Bonnet ..... A63B 21/072 482/106
6,601,743 B2 * 8/2003 Godshaw ..... A45C 9/00 190/113
6,659,921 B2 * 12/2003 Vernon ..... A63B 21/0442 482/114
6,691,318 B1 * 2/2004 Davis ..... A63B 21/0004 2/102
7,707,652 B2 * 5/2010 Senegal ..... A63B 21/4043 2/102
7,854,694 B1 * 12/2010 Frunzi ..... A63B 21/4025 482/124
7,892,064 B2 * 2/2011 Carruth ..... A63H 33/00 446/73
7,998,041 B1 * 8/2011 Johnson ..... A63B 21/4025 482/124
8,641,056 B1 * 2/2014 Carter ..... B62B 1/12 280/30
8,945,017 B2 * 2/2015 Venkatraman ..... A61B 5/0205 600/500
9,061,173 B1 * 6/2015 Felkel ..... A63B 21/4043
9,295,869 B2 * 3/2016 Washington ..... A63B 21/4001
9,592,418 B2 * 3/2017 Burrell ..... A63B 21/0552
9,855,454 B2 * 1/2018 Ismail ..... A63B 21/4025
9,931,531 B2 * 4/2018 Robinson ..... A63B 21/4007
10,029,139 B2 * 7/2018 Miklosi ..... A63B 21/4003
10,286,249 B1 * 5/2019 Sibhatu ..... A63B 21/065
10,575,611 B2 * 3/2020 Dingler ..... A45F 3/04
10,576,325 B2 * 3/2020 Tedesco ..... A63B 21/0442
2005/0090179 A1 * 4/2005 Carruth ..... A63H 33/00 446/71
2006/0144885 A1 * 7/2006 Smeuninx ..... A45F 3/047 224/629
2007/0062996 A1 * 3/2007 Miles ..... A45C 13/103 224/657
2007/0083975 A1 * 4/2007 Senegal ..... A63B 21/0552 2/102
2009/0062088 A1 * 3/2009 Ismail ..... A63B 21/4025 482/124
2010/0292051 A1 * 11/2010 Benumof ..... A63B 21/4009 482/10
2011/0097021 A1 * 4/2011 Curran ..... B32B 5/08 383/109
2013/0267390 A1 * 10/2013 Warren ..... A63B 21/075 482/93
2015/0196077 A1 * 7/2015 McIntire, Jr. ..... A41D 13/0518 2/2.5
2015/0335977 A1 * 11/2015 D'Orazio ..... A63B 69/002 473/438
2016/0157588 A1 * 6/2016 Ford ..... A45C 7/0095 224/657
2016/0287924 A1 * 10/2016 Robinson ..... A63B 21/00065
2018/0343995 A1 * 12/2018 Dingler ..... A45C 7/0027
2019/0022452 A1 * 1/2019 Tedesco ..... A63B 21/4025
2019/0298987 A1 * 10/2019 Freeman ..... A61B 5/6823
2019/0339044 A1 * 11/2019 Arranz ..... A45C 13/103
2020/0129801 A1 * 4/2020 Pace ..... A63B 21/072

* cited by examiner

RECONFIGURABLE EXERCISE BACKPACK

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The present disclosure relates to the field of containers for carrying personal objects generally, and specifically to personal item bags or packs a user wears when moving from lone location to another. More specifically, embodiments related to the present disclosure are related to the field of backpacks for use in holding books, exercise weights, food items, and other personal belongings.

Background of the Invention

People often have insufficient time to regularly attend a gym or other exercise facility. These same people have a lot of excuses for their busy schedule, e.g., family commitments, work schedule, lack of facilities nearby, or other factors. Similar obstacles to working out are faced by those on vacation. Because these people do not have the facility to exercise, they have to look to home or on-the-go exercise regimens.

Unfortunately, known home and on-the-go exercise regimens are sometimes too basic. Basic exercises cannot always maximize gains sought through an exercise regimen. Specialized exercises can maximize gains, but specialized exercise regimens often require weights and resistance equipment that are too expensive to personally own or else bulky to carry around or are generally unavailable except at a gym or other facility. Accordingly a need exists for exercise equipment that can be used for specialized home or on-the-go workouts.

Indeed, personal use exercise equipment exists that can be used for home or on-the-go use. However, known exercise equipment for this purpose is expensive and not all inclusive. Most exercise equipment will not result in a full-body workout. Known personal use exercise equipment is difficult to transport, making spontaneous workouts with the equipment nearly impossible. Spontaneous exercise may be the only way people with busy schedules can exercise. Furthermore, even if an on-the-go person uses a backpack or other bag in their daily commutes to work, school, etc. the bag is often occupied with supplies for carrying out their schedule so that there is no extra room for exercise equipment. Accordingly, a need exists for exercise equipment that is inexpensive, travel-ready, capable of full body workouts, and spontaneously available for on-the-go workouts. Until now, there hasn't been a solution for this need.

SUMMARY OF THE INVENTION

In view of the foregoing, a principle object of the disclosed backpack is to provide spontaneous, on-the-go, total body workouts to everyone. Another object of this specification is to disclose a backpack that can function as both a portable carry bag for personal items and as exercise equipment for one or more users. The backpack is easily configured for changing needs to include accommodating various weights, adapting to a user's particular exercise to be performed, and adjusting resistance bands for variable resistance training. Afterwards, the backpack can be configured to carry personal items such as books and school supplies and is worn across the back using one or more suspension straps. The bag can also be used for rucking.

Further needs in the field include an attractive appearance and easy configuration for various users and functions, each of which has a different scope of needs and requirements.

Previous backpack designs fail to include all of the elements and features found in the present disclosure. A backpack user will find the present disclosure to be more useful when using a backpack in a traditional way, and then converting the backpack to an exercise device with minimal effort and time. The present backpack provides a user with a complete exercise support tool to allow a variety of weight and resistance training while on the move or away from a gym or home.

According to one embodiment, the present disclosure is related to a backpack with reconfigurable handles, reclosable chambers, hooks, a standing platform, stool, and adjustable resistance bands to allow a user to customize the configuration of the backpack to accommodate the backpack's use as an exercise device. In at least some embodiments, the backpack is configured to carry exercise weights securely in internal and external pockets or chambers to allow a user to add and subtract as much weight as desired for a given exercise regimen. The user can also employ the hooks and resistance bands for resistance weight training. Also, the backpack is reconfigurable by changing handle locations, resistance band strength, and weights enclosed within to accommodate the needs of the user during exercise sessions and when using the backpack to carry personal items.

Another preferred embodiment of the backpack may feature durable and sturdy handles throughout, capable of enduring a strenuous and intense weighted workout. Suitably, a top handle may be twice the length of a regular handle so that it can easily accommodate two hands for specifically targeted and two-armed exercises. In one embodiment, the bag may include added handles on the sides which are ideal for implementing precise and specialized lifts. Also featured are a set of strategically placed hooks accompanied by resistance bands that connect to the bag directly, and that can be modified for different resistance levels as well as placed at specific points along the backpack to highlight multiple workouts. As part of the backpack build, there may be space, e.g., a compartment to store weights to increase the heaviness of the bag so that added strength training can be included with a fitness routine. Storage space in the form of added pockets will be highlighted for convenience and functionality—a water bottle, yoga mat, smartphone, miscellaneous items, etc. will fit in with ease and comfort.

Some preferred specifications for the backpack includes a length of eleven (11) inches (up to 12 inches), a height of eighteen (18) inches, a width of six (6) inches, and a handle drop of three and one quarter (3.25) inches. Some preferred features may include a built-in heart rate sensor, Bluetooth capability, resistance bands, and padded straps for comfortable wearing of the pack.

The backpack described generally, above, and in detail, below, making specific reference to the various drawing figures, overcomes several of the limitations inherent in backpacks known in the art previously and minimizes the impact of other limitations.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFFERED EMBODIMENTS

Disclosed is a workout backpack that is capable of enabling a plurality of unique exercises for weight training, resistance training, and complete cardio conditioning. Suitably, the disclosed workout backpack includes built-in weight compartments, hookups for resistance bands, or rucking. The details of the preferred embodiment of the workout backpack are described with reference to the figures.

Figure 1:
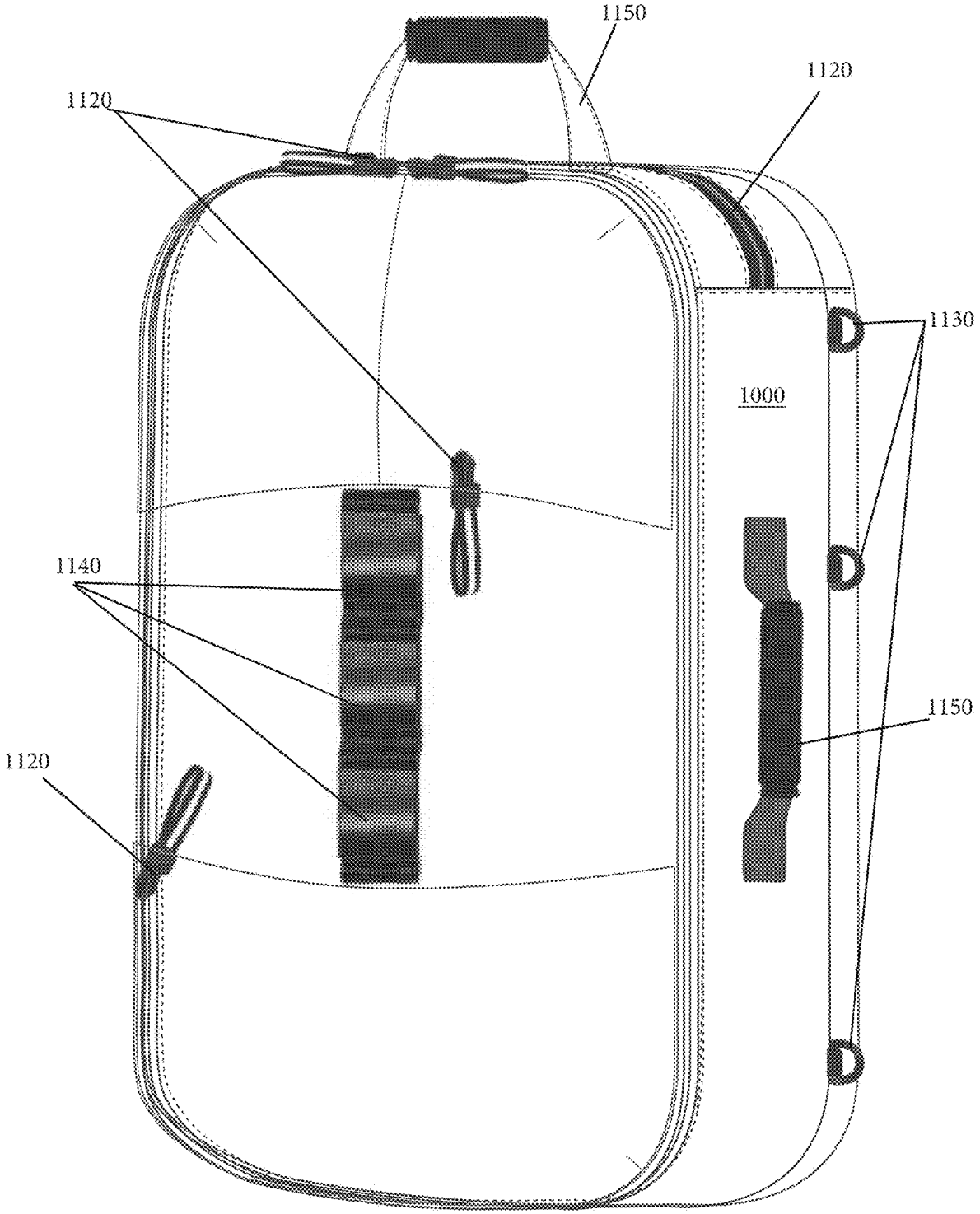
FIG. 1 illustrates a back, right perspective view of a reconfigurable exercise backpack.
Figure 2:
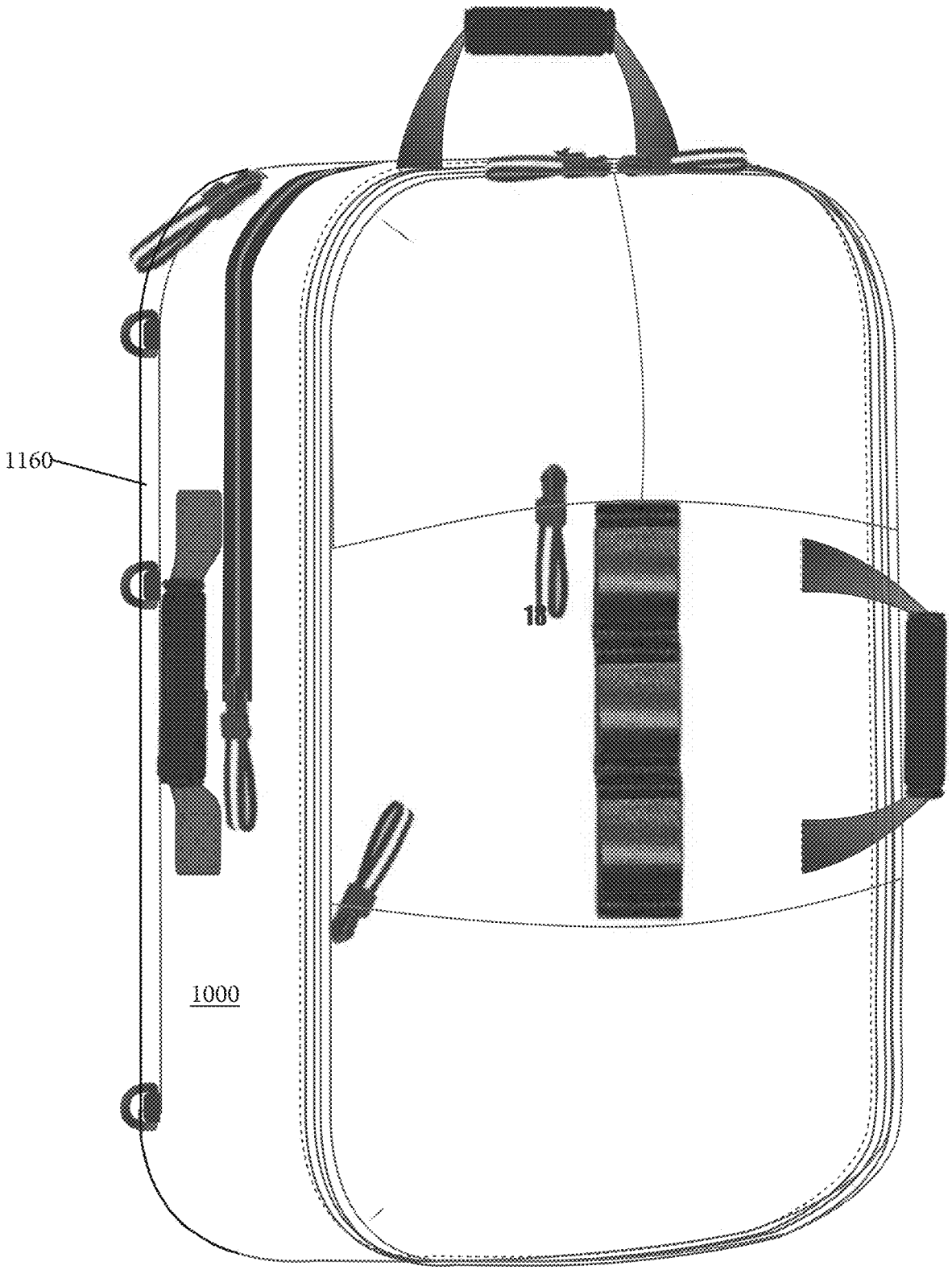
FIG. 2 illustrates a back, left perspective view of an exercise backpack.
Figure 3:
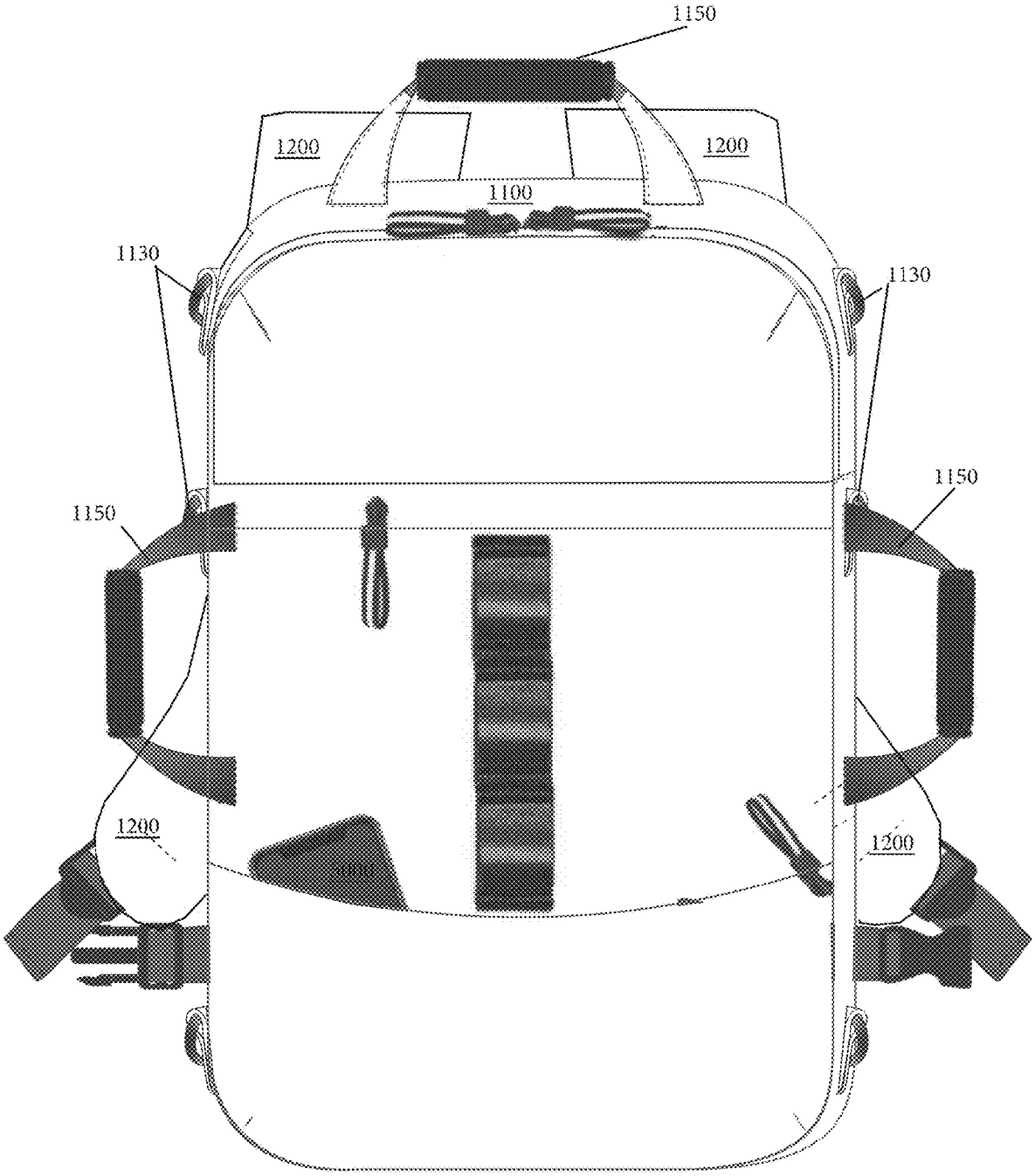
FIG. 3 illustrates a back view of an exercise fitness backpack.
Figure 4:
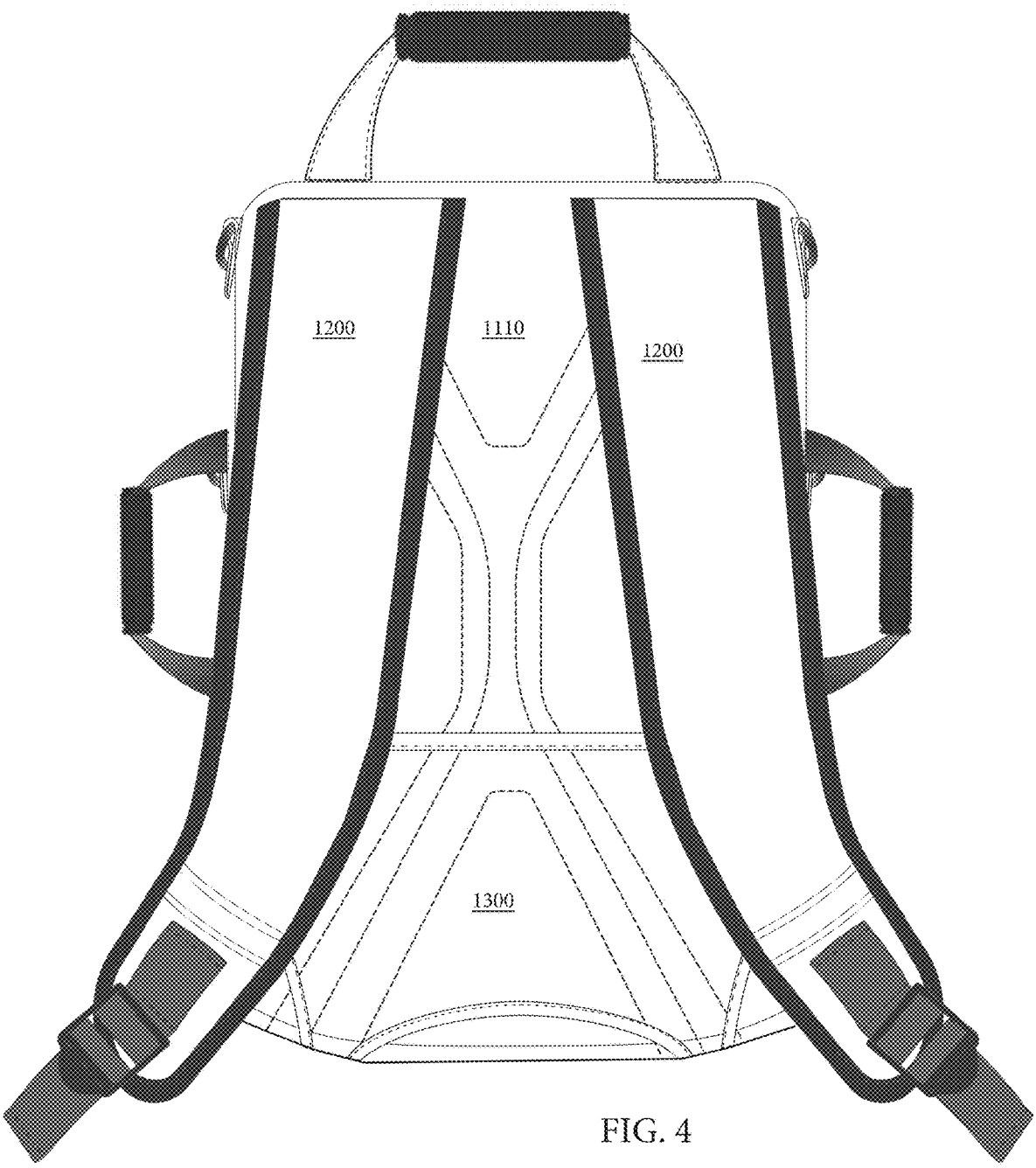
FIG. 4 illustrates a front view of an exercise backpack.

FIG. 1 illustrates a back, right perspective view of a reconfigurable exercise backpack 1000. FIG. 2 illustrates a back, left perspective view of the exercise backpack 1000. FIG. 3 illustrates a back view of the exercise fitness backpack 1000. FIG. 4 illustrates a front view of the exercise backpack 1000. As shown, the exercise backpack 1000 is defined by a body 1100, support straps 1200, and a step flap 1300.

As shown in FIGS. 1 through 4, the body 1100 is suitably defined by a sturdy front support panel 1110, a plurality of zippered utility pockets 1120, a plurality of D-loops 1130, a plurality of attachment loops 1140, and a plurality of haul handles 1150.

Figure 11:
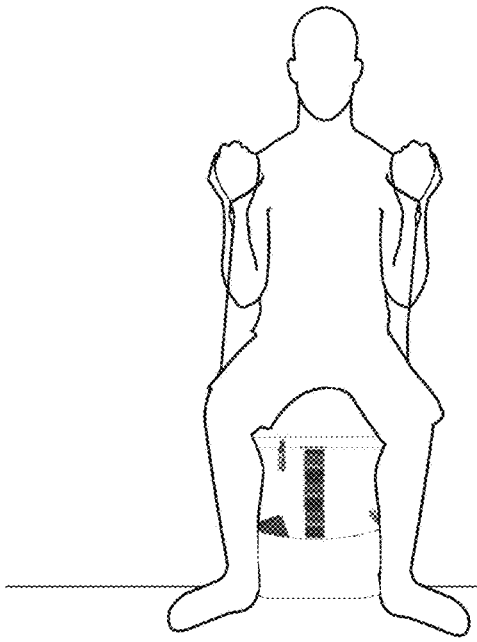
FIG. 11 illustrates an environmental view of an exercise backpack.
Figure 12:
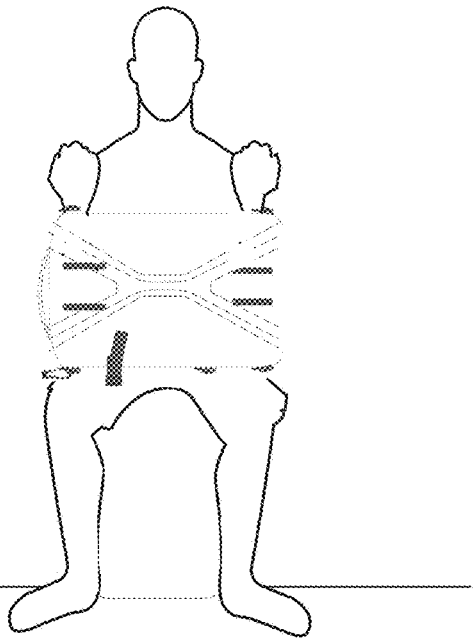
FIG. 12 illustrates an environmental view of an exercise backpack.

As shown, the front support panel 1110 provides rigidity to the pack and is situated in the front portion of the body 1100. When worn as a backpack 1000, the front panel 1110 is abutted against a wearer's back. As discussed below, the front panel may also operate as a stool (see, e.g., FIG. 11) for seated exercise routines.

Figure 7:
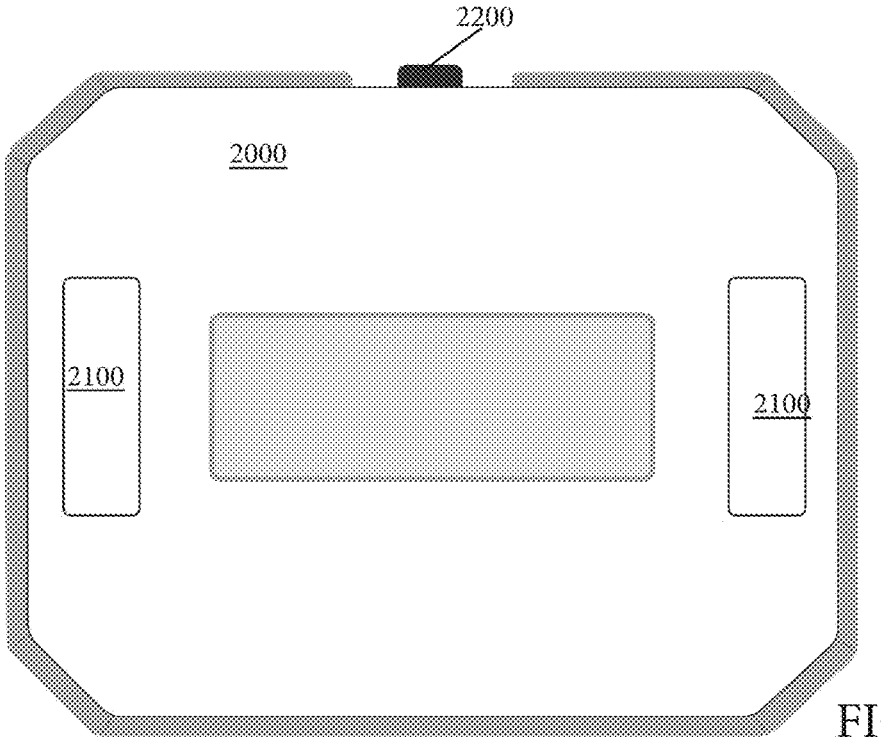
FIG. 7 illustrates a front plan view of a weight insert.

Suitably, zippered utility pockets operate like regular backpack pockets e.g., to hold items such as a cell phone 5000 (see FIG. 4). As discussed later below, the pockets 1120 may have weights inserted into them to increase the heaviness of the pack 1000. A preferred weight 2000 is shown in FIG. 7. The weight 2000 may be essentially a water receptacle with a bottle neck 2200 and handles 2100. In a five (5) pound water weight, the dimensions are 10.925" by 8.661". In a two and a half (2.5) pound water weight, the dimensions may suitably be 9.6" by 7.5".

Figure 10:
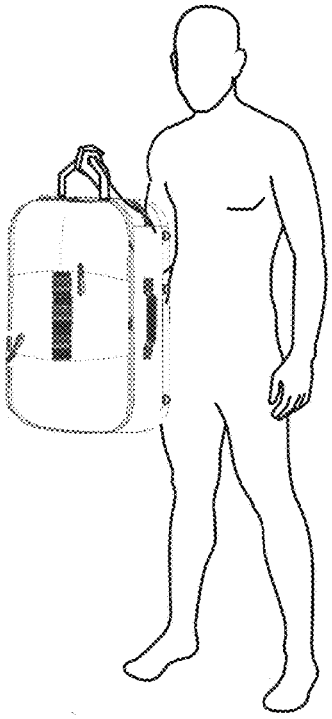
FIG. 10 illustrates an environmental view of an exercise backpack.

Referring back to FIGS. 1 through 4, in the preferred embodiment shown, the left and right sides of the body 1100 include D-loops for, as discussed below, attaching resistance bands 6000 to the bag 1000 (see FIG. 6). Attachment loops 1140 may be provided to the rear of the body 1100. Suitably, haul handles 1150 may be used to lift the bag for toting or for weightlifting (see, e.g., FIG. 10). Some preferred dimensions of the body 1100 include a length of eleven (11) inches (up to 12 inches), a height of eighteen (18) inches, a width of six (6) inches, and a handle drop of three and one quarter (3.25) inches.

As shown in FIGS. 1 through 4, the workout backpack 1000 includes padded shoulder straps 1200 so that the bag operates as a traditional pack. In a preferred embodiment, the straps 1200 are removable. In ordinary use, a platform may be tucked in against the front support panel 1110 behind the straps 1200.

Figure 5:
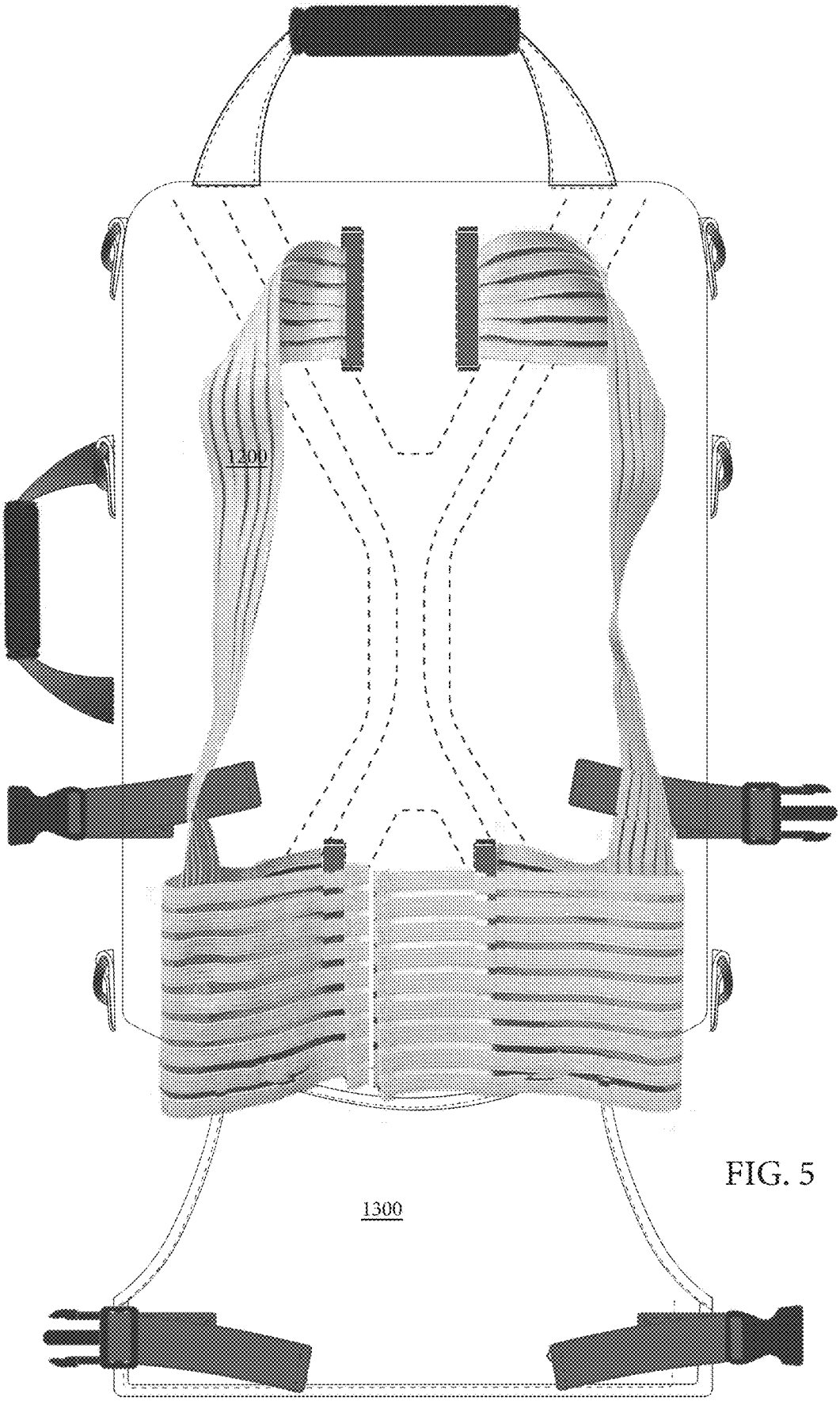
FIG. 5 illustrates a front view of an exercise backpack in an alternate configuration.

FIG. 5 illustrates a front view of an exercise backpack in an alternate configuration. Suitably, the support panel 1300 may be unfurled as shown in FIG. 5 to become a lumbar support pad 1300 when the pack is worn by a user. Suitably, the straps 1200 may be replaced with alternative straps for rucking purposes while the lumbar support pad 1300 is unfurled as shown in FIG. 5. In a preferred embodiment, the support pad or panel 1300 is tucked up by clips on the panel 1110 and the pad 1300.

Figure 6:
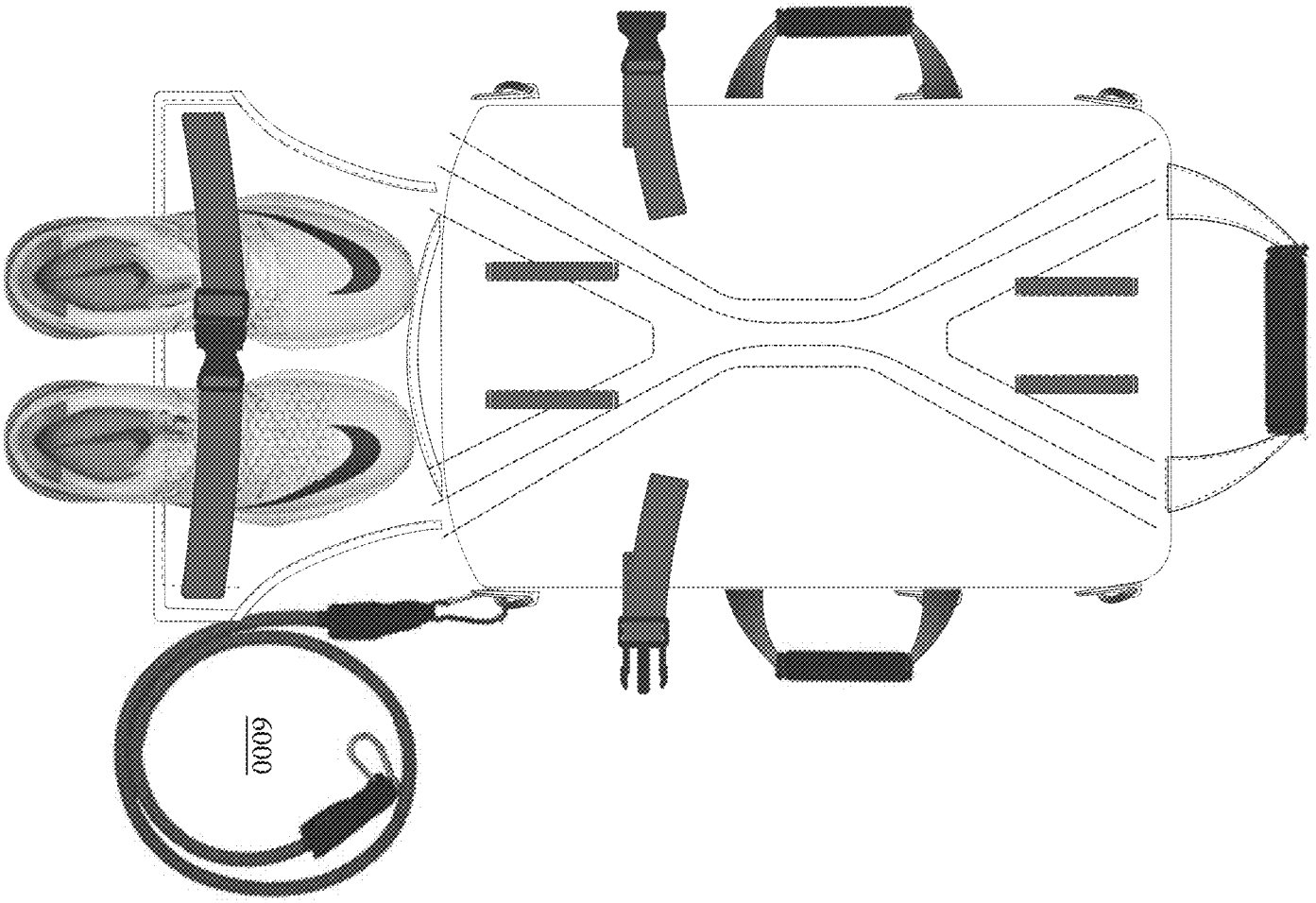
FIG. 6 illustrates an environmental view of an exercise backpack.
Figure 8:
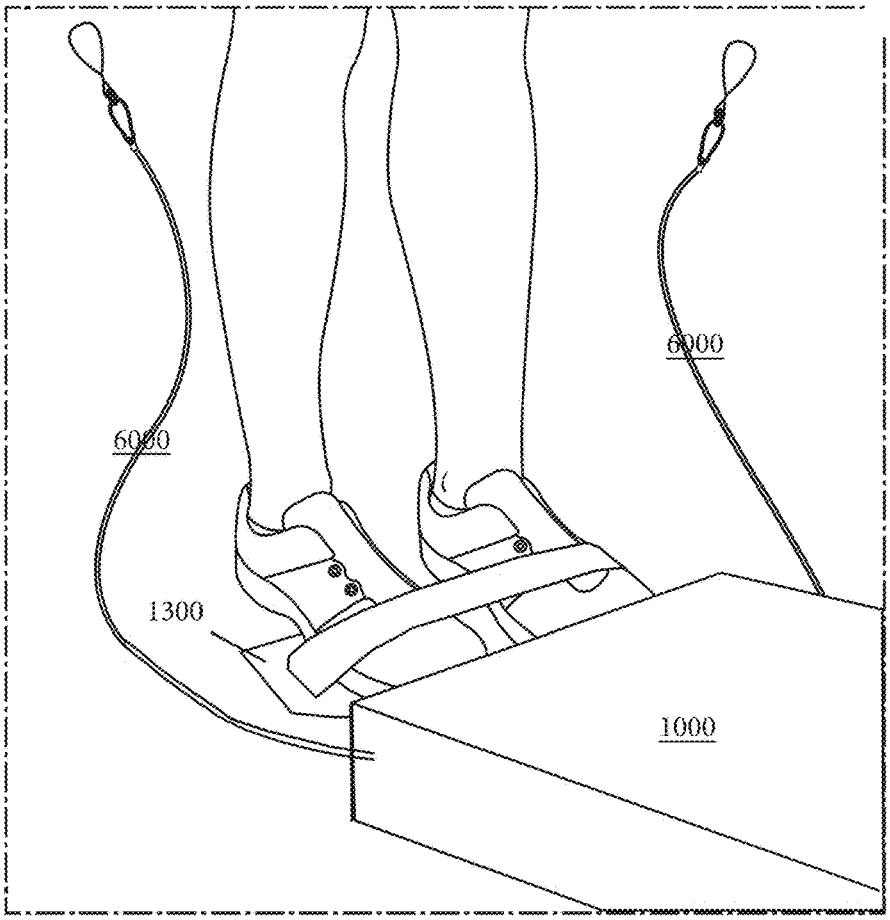
FIG. 8 illustrates an environmental view of an exercise backpack.
Figure 9:
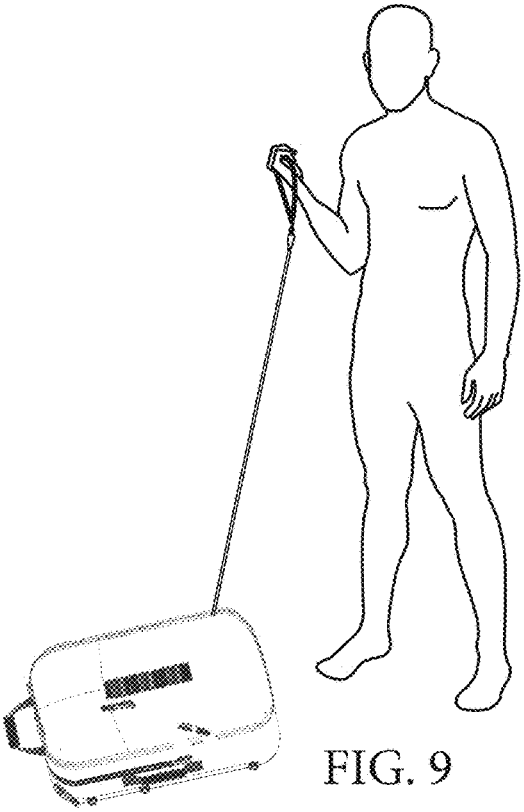
FIG. 9 illustrates an environmental view of an exercise backpack.

FIG. 6 illustrates an alternate configuration of an exercise backpack 1000. FIG. 8 illustrates an environmental view of an exercise backpack 1000. As shown in FIG. 6, the bag has its shoulder straps 1200 removed and the pad 1300 unfurled. Also, a resistance band of varying resistance may be coupled to a D ring of the bag. As shown, the pad 1300 may be stepped on by a user so that resistance bands 6000 may be operated to accomplish exercise movements. In one embodiment, the user may strap his or her feet to the pad 1300.

FIGS. 9 through 12 illustrates various environmental views of an exercise backpack 1000. As shown, the bag may be used to accomplish various forms of exercise movements. Movements (by lifting the bag 1000 or resistance bands) may include: curls; tricep extensions; weighted backpack 1000 swings (c.f., kettlebell swings); rows; clings; snatch and clings; back squats; front squats; lunges; Bulgarian single leg lunges; shoulder press; single arm upright rows; assisted crunches; weighted planks; weighted pushups; weighted backpack farmer walks; band resistance boxing; and the like.

Although the apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. A method of mobile exercising, comprising the steps of:

locating a reconfigurable exercise backpack comprising:

a body that is defined by a front support panel;

a plurality of zippered utility pockets; and, a plurality of D-loops;

wherein the front support panel provides rigidity to the pack and is situated in the front portion of the body, wherein the front panel is abutted against a wearer's back whenever the backpack is worn, and wherein the front panel is a stool for seated exercise routines when the reconfigurable exercise backpack is not worn by the wearer;

wherein at least one of the zippered utility pockets includes a water weight inserted therein, wherein the water weight is defined by a water receptacle with a bottleneck and handles, wherein the water weight weighs five (5) pounds;

wherein the plurality of D-loops are disposed on left and right sides of the body, and wherein at least one of the D-loops is attached to a resistance band;

wherein the resistance band has a proximate end connectively attached to at least one D-loop and a distal end connectively attached to a hook;

a plurality of haul handles, wherein any one of said haul handles is used to lift the bag for toting or weight lifting, and wherein said haul handles are defined by a first handle, wherein the first handle is positioned on the top of the body, a second handle wherein the second handle is positioned on a first side of the body, and a third handle, wherein the third handle is positioned on a second side of the body a plurality of attachment loops, wherein said plurality of attachment loops are disposed on a rear of the body; and, at least one removable and padded shoulder strap connected to the body and strung across the front panel;

a support panel, wherein the support panel is unfurled from the body so that it is either a lumbar support pad whenever the backpack is worn by the wearer or a step for the wearer during exercise routines;

sitting the wearer on the front panel and having the wearer pull the resistance band, positioning the wearer near the backpack, removing the at least one removable padded shoulder strap from the body and having the wearer lift the backpack; and, standing the wearer on the support panel and having the wearer pull the resistance band.

* * * * *